US008827089B2

(12) United States Patent
Stukenberg et al.

(10) Patent No.: US 8,827,089 B2
(45) Date of Patent: Sep. 9, 2014

(54) VERTICAL DISPLAY STRUCTURE WITH BUMP OUT ASSEMBLY

(75) Inventors: Joseph R. Stukenberg, Minneapolis, MN (US); Vaughan Schaub, Golden Valley, MN (US)

(73) Assignee: Target Brands, Inc., Minneapolis, MN (US)

( * ) Notice: Subject to any disclaimer, the term of this patent is extended or adjusted under 35 U.S.C. 154(b) by 396 days.

(21) Appl. No.: 13/315,387

(22) Filed: Dec. 9, 2011

(65) Prior Publication Data

US 2013/0146550 A1 Jun. 13, 2013

(51) Int. Cl.

| | |
|---|---|
| ***A47F 5/08*** | (2006.01) |
| ***A47F 7/02*** | (2006.01) |
| ***A47G 29/02*** | (2006.01) |

(52) U.S. Cl.

USPC ..... 211/103

(58) Field of Classification Search

CPC ..... A47F 5/00; A47F 5/08; A47F 5/0815; A47F 5/0823; A47F 5/0876; A47F 5/0884; A47F 7/00; A47F 7/02; A47G 29/02

USPC ..... 211/103, 87.01, 85.2, 49.1, 50, 57.1, 211/59.1, 59.2

See application file for complete search history.

(56) References Cited

U.S. PATENT DOCUMENTS

| | | | |
|---|---|---|---|
| 3,495,717 | A | 2/1970 | Lavin et al. |
| 3,687,280 | A | 8/1972 | Fortannaz |
| 4,936,565 | A | 6/1990 | Fredrickson |
| 4,938,366 | A | 7/1990 | Carroll |
| 4,982,852 | A | 1/1991 | Johansen |
| 5,172,814 | A | 12/1992 | Pell et al. |
| 5,944,203 | A | 8/1999 | Vlah et al. |
| 6,059,124 | A | 5/2000 | Weck et al. |
| 6,299,002 | B1 | 10/2001 | Garnier |
| 6,336,564 | B1 | 1/2002 | Garnier |
| D608,566 | S | 1/2010 | Trinh et al. |
| D634,861 | S | 3/2011 | Whittier et al. |
| 2006/0213851 | A1 | 9/2006 | Grueneberg |
| 2007/0034581 | A1 | 2/2007 | Weck et al. |
| 2007/0090073 | A1 | 4/2007 | Blum et al. |
| 2007/0241070 | A1 | 10/2007 | Maheu et al. |
| 2007/0278168 | A1 | 12/2007 | Li |
| 2008/0099418 | A1 | 5/2008 | Wells |
| 2010/0044326 | A1 | 2/2010 | Meyer-Hanover et al. |
| 2010/0051769 | A1 | 3/2010 | Tyson |
| 2010/0155348 | A1 | 6/2010 | Berry et al. |
| 2010/0224582 | A1 | 9/2010 | Loy, II et al. |
| 2010/0326939 | A1 | 12/2010 | Clark et al. |
| 2011/0049066 | A1 | 3/2011 | Katz |

OTHER PUBLICATIONS

Office Action from Canadian Patent Application No. 2,773,678, mailed Jul. 26, 2012 (3 pages).

*Primary Examiner* — Michael Safavi

(74) *Attorney, Agent, or Firm* — Griffiths & Seaton PLLC; JoAnn M. Seaton

(57) ABSTRACT

A display system includes a vertical display structure and a bump out assembly. The vertical display structure includes a substantially horizontal support, a pair of substantially vertical supports, and a slotted board. The pair of substantially vertical supports is disposed upright relative to the substantially horizontal support, and the slotted board is supported between the substantially horizontal support and the pair of substantially vertical supports. The bump out unit couples to the vertical display structure and comprises an outer frame, a slotted display panel, and a substantially horizontal bracket. The outer frame has an extended sidewall extending axially from the vertical display structure and surrounding the substantially horizontal bracket. The slotted display panel is disposed over the outer frame. The substantially horizontal bracket couples the outer frame and the slotted display to the pair of substantially vertical supports.

22 Claims, 11 Drawing Sheets

VERTICAL DISPLAY STRUCTURE WITH BUMP OUT ASSEMBLY

BACKGROUND OF THE INVENTION

Display stands are used for displaying product. To accommodate various types of product packaging, display stands have many different configurations. For example, one type of display stand includes a rack that can be used for hanging clothing products disposed on a hanger. Another type of display stand includes a panel and rods extending outwardly from the panel. Small items, such as accessories, jewelry, gift cards, and computer products, are attached to backers having openings for hanging the product from the rods.

To attract customer attention, in some cases, the display stands include signage or other conspicuous indicia. Other display stands have curved or wavy forms for displaying merchandise in an eye-catching manner. In addition to attracting attention, still other display stands promote customer interest by including low tech interactive components, such as rotating panels or racks, or high tech components, such as interactive displays.

SUMMARY OF THE INVENTION

One aspect of the present invention relates to an assembly for selective coupling to a vertical display structure. The assembly comprises an extended sidewall member, a substantially horizontal bracket at least partially surrounded by the extended sidewall member, a slotted panel disposed over the extended sidewall member and coupled to the substantially horizontal bracket, and a front frame coupled to the slotted panel. Visual depth is provided when the assembly is coupled to the vertical display structure and is placed adjacent to another vertical display structure.

BRIEF DESCRIPTION OF THE DRAWINGS

Embodiments of the invention will be described with respect to the figures, in which like reference numerals denote like elements, and in which.

DETAILED DESCRIPTION

Figure 1:
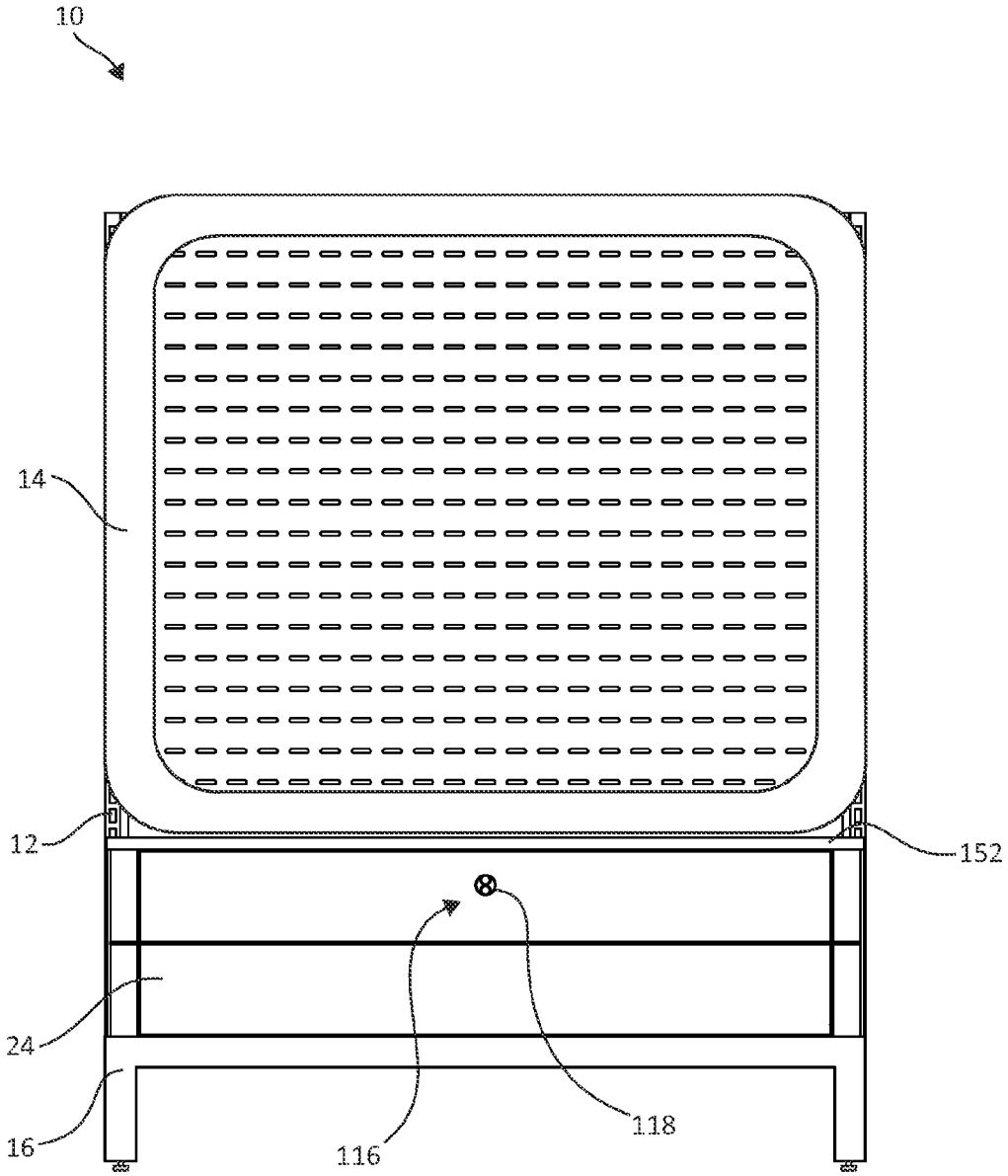
FIG. 1 is a front view illustration of an enhanced vertical display structure, according to one embodiment of the present invention.
Figure 2:
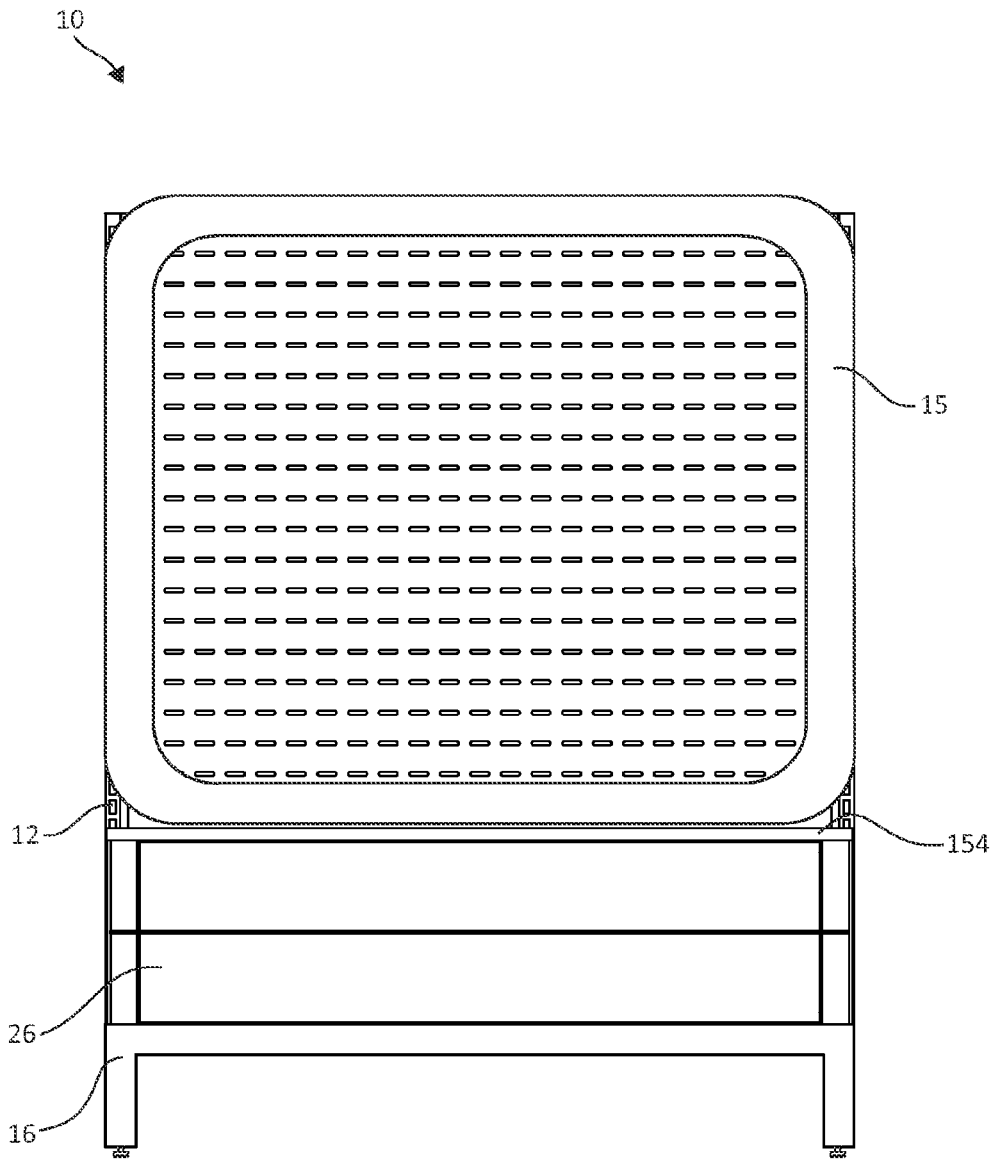
FIG. 2 is a back view illustration of the enhanced vertical display structure of FIG. 1, according to one embodiment of the present invention.
Figure 3:
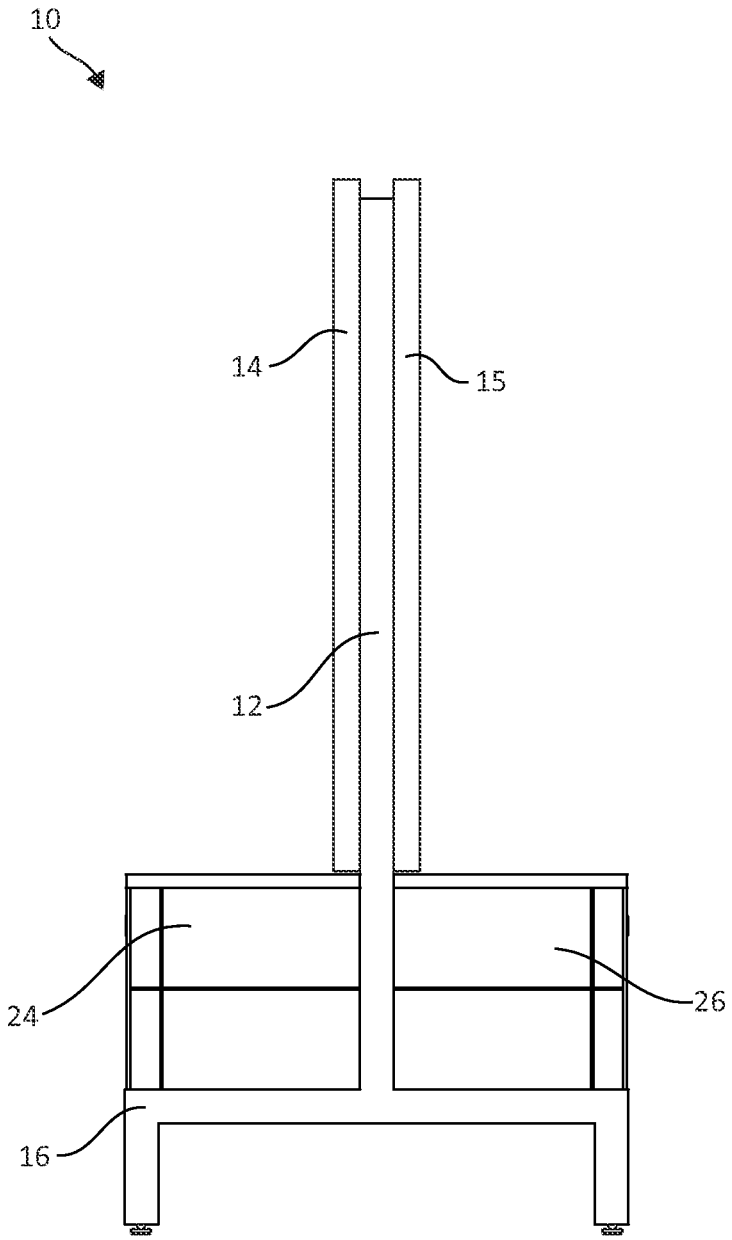
FIG. 3 is a side view illustration of the enhanced vertical display structure of FIG. 1, according to one embodiment of the present invention.

The following detailed description of the invention provides examples and is not intended to limit the invention or the application and uses of the invention. Furthermore, there is no intention to be bound by any theory presented in the preceding background of the invention or the following detailed description of the invention.

An enhanced vertical display structure is provided for adding depth, interest, and overall profile to a retail display system. In particular, the enhanced vertical display structure includes a vertical display unit and a bump out assembly. The bump out assembly includes a display panel that hangs vertically and is spaced an axial distance away from the vertical display unit. Thus, when the enhanced vertical display structure is disposed adjacent to a standard vertical display structure (e.g., a vertical display structure without a bump out assembly), a product display area of the enhanced vertical display structure extends further out from its vertical display unit than a product display area of the standard vertical display structure extends from its vertical display unit.

In particular, according to an embodiment, the vertical display unit includes a pair of vertical supports and a slotted board extending between the pair of vertical supports. The bump out assembly couples to the vertical display unit and comprises an outer frame, a slotted display panel, and a horizontal bracket. The outer frame has an extended sidewall extending axially from the vertical display unit and surrounding the horizontal bracket. The slotted display panel is disposed over outer frame. The horizontal bracket couples the outer frame and the slotted display to the pair of vertical supports.

With reference now to FIGS. 1-4, a vertical display structure 10 is illustrated. Vertical display structure 10 includes a vertical display unit 12 and one or more bump out assembly or bump out unit 14 and 15. In one embodiment, vertical display unit 12 supports attachment features for displaying product 27 (shown in FIGS. 11 and 12) and/or vertical display unit 12 provides compartments for storing product. According to an embodiment, vertical display unit 12 includes a support frame 16, a plurality of boards 18, 20, and 22, and one or more bunkers 24 and 26.

Figure 5:
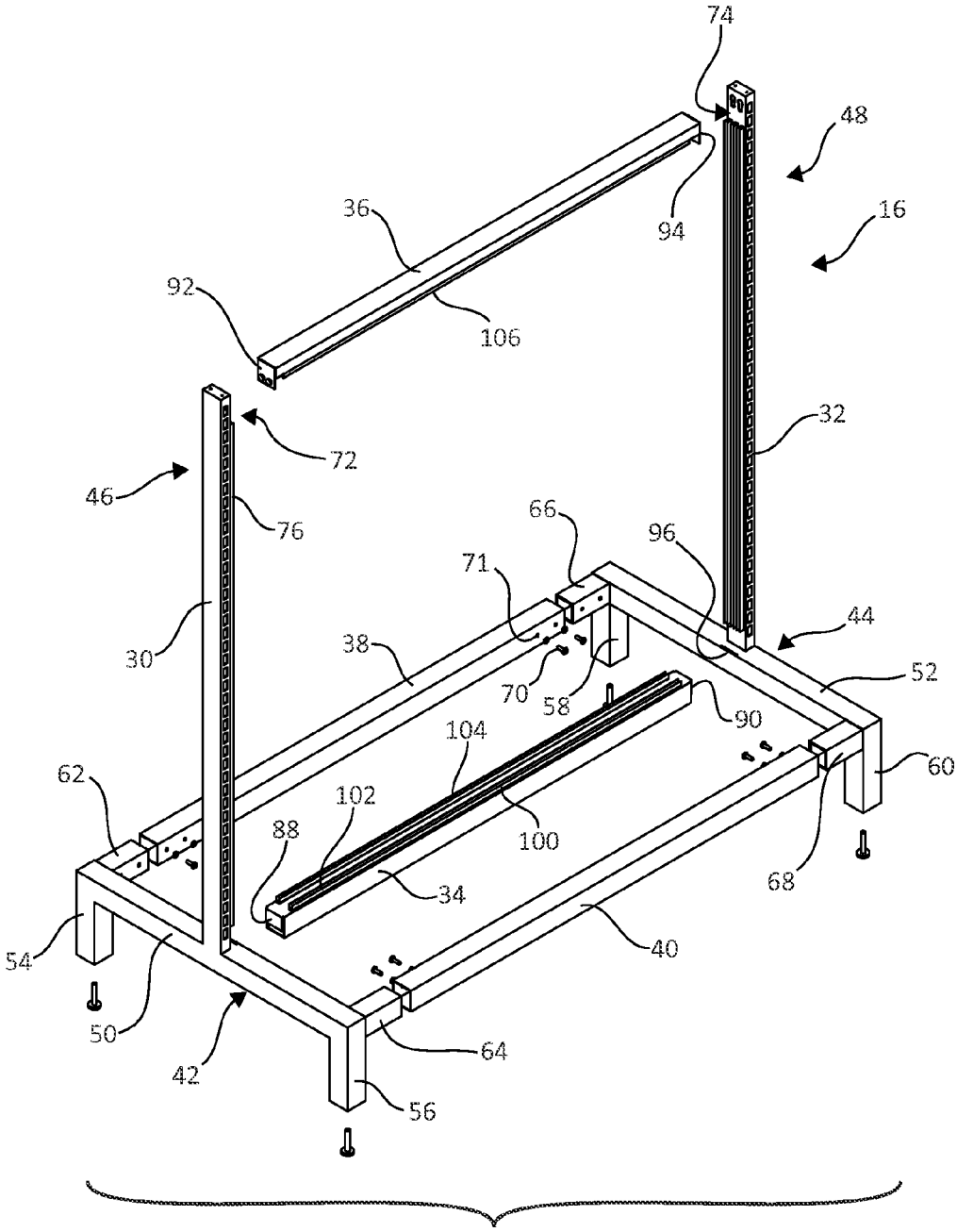
FIG. 5 is an exploded, perspective view illustration of a support frame of the enhanced vertical display structure of FIG. 1, according to one embodiment of the present invention.
Figure 6:
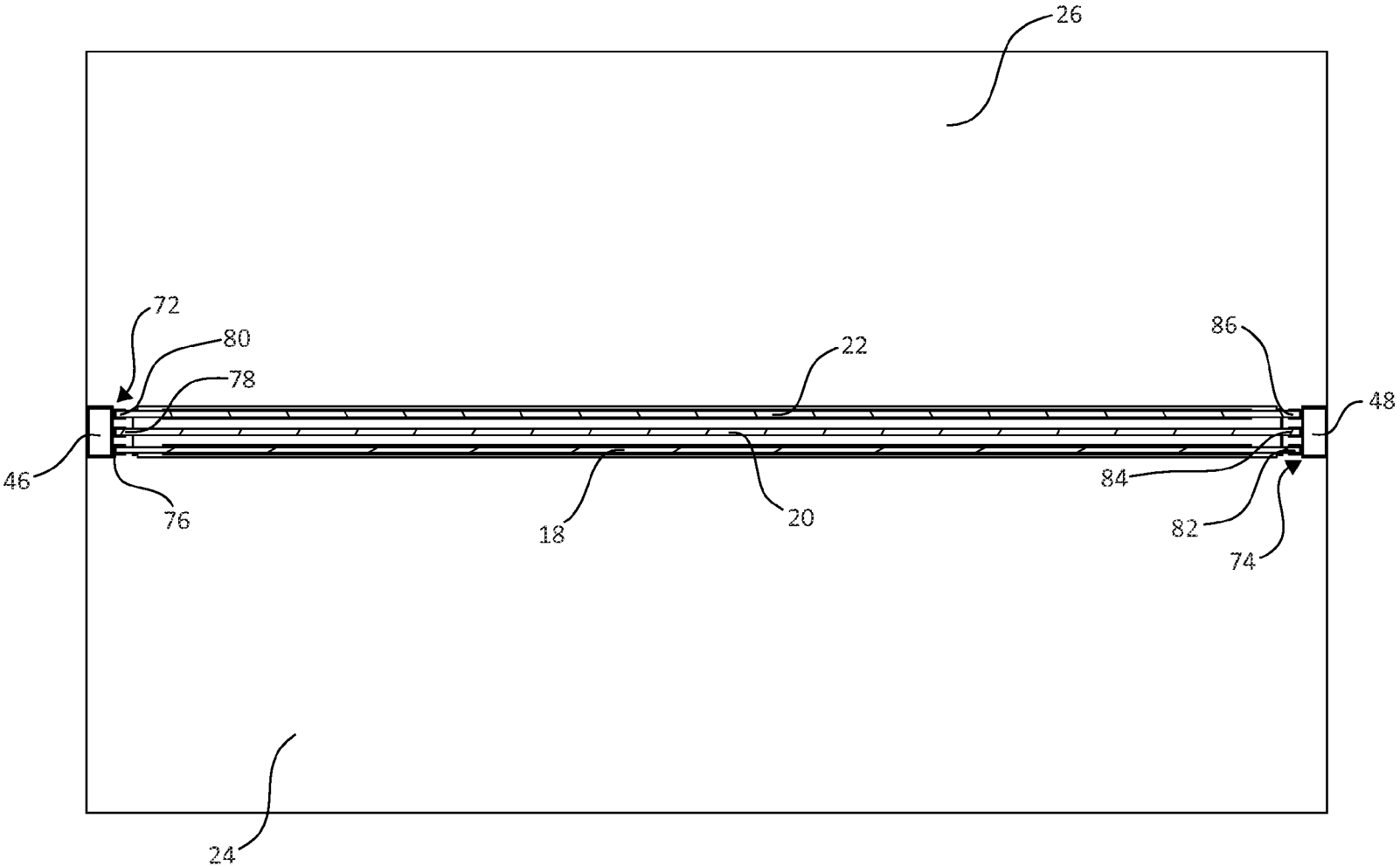
FIG. 6 is a cross-sectional view illustration of the enhanced vertical display structure of FIG. 4 taken along line 6-6, according to one embodiment of the present invention.

With additional reference to FIGS. 5 and 6, support frame 16 supports support boards 18, 20, and 22 and bunkers 24 and 26. In this regard, support frame 16 is made up of components including a pair of vertical supports or vertically extending supports 30 and 32, a pair of horizontal supports or horizontally extending supports 34 and 36, and support bars 38 and 40. Each component is separately formed, and then the components are assembled and fastened together to form support frame 16, in an embodiment. In another embodiment, vertical supports 30 and 32 and support bars 38 and 40 are formed as a single component, and horizontal supports 34 and 36 are separately attached so that support boards 18, 20, and 22 can be selectively inserted between or removed from vertical supports 30 and 32 as will be further described below. The components of support frame 16 are made of materials, such as metal, plastic, wood, or another material suitable for providing a robust structure.

Vertical supports 30 and 32 are configured to be substantially similar to each other and to be substantially vertically oriented. Each of vertical supports 30 and 32 includes a bottom section 42 or 44 and a substantially vertical section generally referred to through this specification as a vertical section 46 or 48, according to an embodiment. Bottom sections 42 and 44 define a base for vertical display structure 10. In an embodiment, bottom sections 42 and 44 include corresponding horizontal bars 50 and 52, support legs 54, 56, 58, and 60, and connector legs 62, 64, 66, and 68. Horizontal bars 50 and 52 are substantially equal in length and configuration and to be substantially horizontally oriented. Support legs 54, 56, 58, and 60 are configured to elevate vertical sections 46 and 48 off a floor to provide height to vertical display structure 10. In one embodiment, support legs 54 and 56 extend from respective ends of horizontal bar 50, and support legs 58 and 60 extend from respective ends of horizontal bar 52. Support legs 54 and 56 and horizontal bar 50 are formed from a single piece of material, and support legs 58 and 60 and horizontal bar 52 are formed from a single piece of material, in an embodiment. In another embodiment, support legs 54 and 56 and support legs 58 and 60 are separately formed from horizontal bars 50 and 52. For example, support legs 54 and 56 and/or support legs 58 and 60 are formed from wood, and horizontal bars 50 and 52 are formed from metal.

To form the base of vertical display structure 10, connector legs 62 and 64 extend substantially orthogonally relative to horizontal bar 50 and corresponding support legs 54 and 56, and connector legs 66 and 68 extend substantially orthogonally relative to horizontal bar 52 and corresponding support legs 58 and 60. Connector legs 62, 64, 66, and 68 each include mating mechanisms for mating with corresponding ends of support bars 38 and 40 to secure support bar 38 between connector legs 62 and 66 and support bar 40 between connector legs 64 and 68. For example, the mating mechanisms comprise extensions (not shown) and openings, where the extensions protrude from one or both of connector legs 62 and 66, one or both of connector legs 62 and 68, or support bars 38 and 40. The openings for receiving the protrusions are formed on the other of the connector legs 62 and 66, connector legs 64 and 68, or support bars 38 and 40. When the mating mechanisms are mated with each other, fasteners (e.g., fasteners 70) can be inserted through openings (e.g., threaded openings 71) formed on one or both of connector legs 62, 64, 66, and 68 or support bars 38 and 40. Although connector legs 62, 64, 66, and 68 and support bars 38 and 40 form a substantially rectangular base, fewer or more legs and/or support bars are included in other embodiments to define another shape of the base.

In one embodiment, vertical sections 46 and 48 are substantially equal in length and are configured to be substantially similar to each other. To maintain boards 18, 20, and 22 between vertical sections 46 and 48, vertical section 46 extends substantially perpendicularly relative to horizontal bar 50 from a position that is substantially similar to a position on horizontal bar 52 from which vertical section 48 extends. In an embodiment, vertical section 46 extends from a position equidistant from ends of horizontal bar 50, and similarly, vertical section 48 extends from a position on horizontal bar 52 that is equidistant from the ends thereof. Alternatively, vertical section 46 is disposed closer to one end of horizontal bar 50 than another end, and vertical section 48 is disposed at a substantially similar position on horizontal bar 52.

Vertical sections 46 and 48 have interior-facing surfaces 72 and 74 including tracks 76, 78, 80, 82, 84, and 86. Tracks 76, 78, 80, 82, 84, and 86 are each suitably configured for maintaining at least a portion of the edges of boards 18, 20, and 22. In an embodiment, vertical sections 46 and 48 each includes three tracks, tracks 76, 78, and 80 and tracks 82, 84, and 86, respectively. Tracks 76, 78, 80, 82, 84, and 86 extend along substantially an entire length of the corresponding vertical section 46 or 48, in an embodiment. In another embodiment, one or more of tracks 76, 78, 80, 82, 84, and 86 is made up of sections that are staggered along the lengths of vertical sections 46 and/or 48. Tracks 76, 78, 80, 82, 84, and 86 are grooves formed in interior-facing surfaces 72 and/or 74, in an embodiment. Alternatively, tracks 76, 78, 80, 82, 84, and 86 are defined by walls extending from interior-facing surfaces 72 and/or 74. Although vertical sections 46 and 48 include three tracks 76, 78, 80, 82, 84, and 86 each, other embodiments may include fewer or more tracks. A total number of tracks on each of vertical sections 46 and 48 depends on a desired number of boards (e.g., boards 18, 20, and 22) to be disposed therebetween.

To maintain boards 18, 20, and 22 at desired vertical positions, horizontal supports 34 and 36 extend between vertical sections 46 and 48. In one embodiment, horizontal support 34 extends substantially horizontally between bottom ends of vertical sections 46 and 48, and horizontal support 36 extends substantially horizontally between top ends of vertical sections 46 and 48. Horizontal supports 34 and 36 are fastened to vertical sections 46 and 48 by fastening mechanisms 88, 90, 92, and 94, in an embodiment. For example, fastening mechanisms 88 and 90 for horizontal support 34 comprise protrusions extending from respective ends of horizontal support 34 that are inserted into slits 96 (slit on vertical section 46 not shown). In another example, fastening mechanisms 92 and 94 comprise fasteners (e.g., screws, bolts, and the like) that are inserted through openings formed on respective ends of horizontal support 36 and openings formed on vertical sections 46 and 48. Although fastening mechanisms 88 and 90 and fastening mechanisms 92 and 94 are illustrated as having different configurations, both can have similar configurations in other embodiments.

Each of horizontal supports 34 and 36 includes tracks 100, 102, 104, and/or 106 (only one track 106 of horizontal support 36 is visible) configured to retain edges of boards 18, 20, and 22. Tracks 100, 102, 104, and/or 106 are each a groove formed in a corresponding one of horizontal supports 34 and 36, in an embodiment. In another embodiment, tracks 100, 102, 104, and 106 are formed between walls that extend from one of horizontal supports 34 and 36 a distance sufficient for retaining edges of boards 18, 20, and 22. In an embodiment, three tracks 100, 102, and 104 are included on horizontal support 34, and three tracks 106 (only one track 106 of horizontal support 36 is visible) are included on horizontal support 36. More or fewer tracks are included on one or both of horizontal supports 34 and 36, depending on a total number of boards (e.g., boards 18, 20, and 22) to be held in position.

One or more of tracks 100, 102, 104, and 106 extends substantially an entire length of the corresponding horizontal support 34 or 36, in an embodiment. In accordance with another embodiment, one or more of tracks 100, 102, 104, and 106 comprises track sections that are staggered along a length of the corresponding horizontal support 34 or 36. The track sections are uniform or non-uniform in length.

Figure 4:
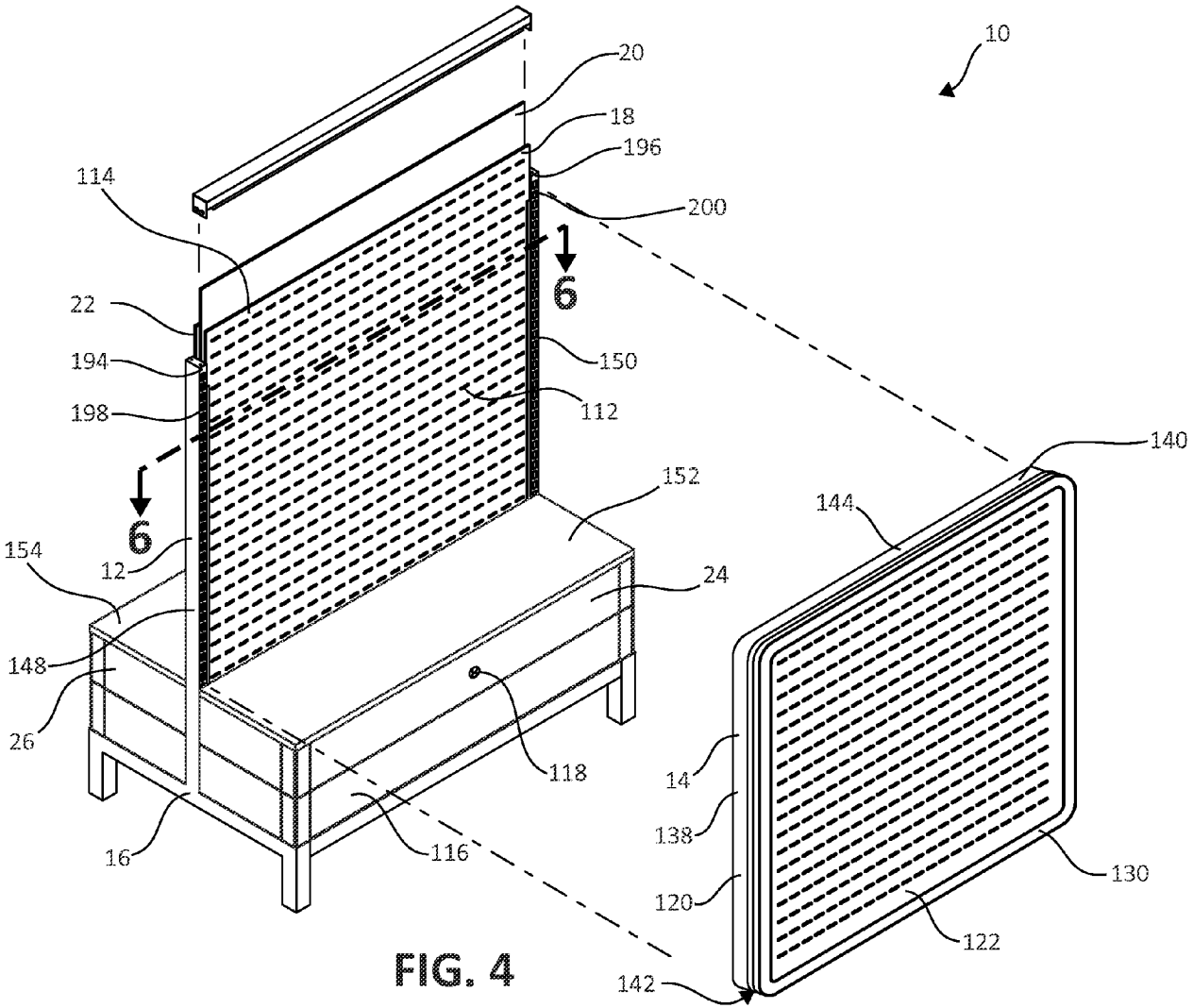
FIG. 4 is an exploded, perspective view illustration of the enhanced vertical display structure of FIG. 1, according to one embodiment of the present invention.

With reference to FIG. 4, support boards 18, 20, and 22 are configured to provide a surface for hanging product and/or to provide an aesthetically pleasing appearance for vertical display structure 10. In an embodiment, three support boards 18, 20, and 22 are included as part of vertical display structure 10 and are made up of two outer boards or slotted boards 18 and 22 and an intermediate board 20 disposed therebetween.

Support boards 18, 20, and 22 have substantially similar dimensions. According to one embodiment, outer board 18 includes a plurality of rows of slots 112 and a peripheral edge portion or outer periphery 114 without slots. Each row includes an array of slots 112 arranged end to end with each other. Although each slot 112 has an elongated rectangular shape, slots 112 have different configurations, such as round, ovular, or the like, in other embodiments. Additionally, although slots 112 are arranged in rows in the Figure, other embodiments include slots arranged in concentric circles or other patterns. In still other embodiments, the slots 112 are dispersed randomly on outer board 18. Outer board 18 is formed from a material having suitable structural integrity for suspending attachments and/or product 27 therefrom, such as an acrylic material, plastic, wood, metal, and the like. Although not shown, outer board 22 is formed substantially similar to outer board 18, and thus, also includes slots 112 and a peripheral edge portion 114 without slots.

To improve the appearance of vertical display structure 10, intermediate board 20 is configured to prevent light from shining through slots 112 of outer board 18 onto outer board 22. Intermediate board 20 is a solid panel without openings, in an embodiment. In another embodiment in which support boards 18, 20, and 22 are not intended to be used for product display, one or both of outer boards 18 and 22 comprises a solid panel, and/or one or more of support boards 18, 20, and 22 is omitted.

In one embodiment, bunkers 24 and 26 are included to provide a storage area for product 27 and/or to provide an additional surface for displaying product 27. Bunkers 24 and 26 are disposed on support frame 16. In an embodiment, bunker or front bunker 24 is disposed on a first half of support frame 16, bunker or back bunker 26 is disposed on a second half of support frame 16, and bunkers 24 and 26 are separated from each other by boards 18, 20, and 22. Front bunker 24 includes one or more pull out drawers 116. Pull out drawer 116 includes a locking mechanism 118 for securing product within drawer 116. Although not shown, back bunker 26 includes a pull out drawer in another embodiment. In alternate embodiments, one or both bunkers 24 or 26 are omitted.

Referring now to FIGS. 1-4 and 7, bump out assemblies 14 and 15 are configured to provide visual depth to vertical display structure 10. In this regard, bump out assemblies 14 and 15 are selectively coupled to vertical display unit 12. Bump out assembly 14 includes an outer frame 120, a slotted display panel or slotted panel or substantially planar panel 122, one or more horizontal brackets 124, 126, and 128, and a front frame 130. As will be appreciated, bump out assembly 15 is configured to be substantially similar to bump out assembly 14.

Outer frame 120 has an extended sidewall member or extended sidewall 132 for extending axially from vertical display structure 10 and surrounding at least a portion of one or more of horizontal brackets 124, 126, and 128. Extended sidewall 132 extends between two faces (e.g., first face 134 and second face 136) and includes four wall segments or segments 138, 140, 142, and 144 forming an outer peripheral surface. Extended sidewall 132 forms a cavity 146 for horizontal brackets 124, 126, and 128 and is formed from material suitable for concealing horizontal brackets 124, 126, and 128 in cavity 146. In one embodiment, extended sidewall 132 has a depth that is substantially equal to or greater than a depth of horizontal brackets 124, 126, and 128. For example, extended sidewall 132 comprises an opaque material, such as a suitable plastic, acrylic, metallic, wooden or other material. Although extended sidewall 132 forms a substantially rectangular outline with curved corners as illustrated, extended sidewall 132 can have another shape. For example, extended sidewall 132 is circular, ovular, square, or another polygon.

In accordance with an embodiment, extended sidewall 132 (and hence, bump out assemblies 14 and 15) is configured to substantially cover an upper portion of vertical display unit 12. In this regard, at least three sides of a perimeter of extended sidewall 132 matches or extends beyond a perimeter of vertical display unit 12 defined by top horizontal support 36 and vertical sections 46 and 48. Extended sidewall 132 has a largest width (e.g., a width measured between outer peripheral surfaces of vertical wall segments 138 and 140) that is substantially equal to or greater than a width between exterior-facing surfaces 148 and 150 of vertical sections 46 and 48, respectively. In an embodiment, to cover and hide at least half of the upper portion of vertical display unit 12, a height of extended sidewall 132 (e.g., measured between outer peripheral surfaces of horizontal wall segments 142 and 144) is substantially equal to at least half of a height of vertical sections 46 and 48. For example, as illustrated, extended sidewall 132 has outer dimensions substantially similar to outer dimensions of board 18. In another embodiment, the height of extended sidewall 132 is greater than half of the height of vertical sections 46 and 48. In an example, extended sidewall 132 is configured to extend from the top ends of vertical sections 46 and 48 to a location a few millimeters to a few centimeters above top surface 152 and 154 of bunkers 24 and 26.

Slotted display panel 122 is disposed over outer frame 120 and is employed to display products 27 (FIGS. 11 and 12) on bump out assembly 14. Slotted display panel 122 has an outer perimeter shape that corresponds to the shape of extended sidewall 132 and is substantially similar in width and height, in one embodiment. In another embodiment, slotted display panel 122 is larger than extended sidewall 132 in width and/or height. According to an embodiment, slotted display panel 122 is coupled to extended sidewall 132. In an embodiment, slotted display panel 122 and extended sidewall 132 are glued, ultrasonically welded, or otherwise adhered or coupled together. Although slotted display panel 122 is illustrated as having a thickness that is less than that of extended sidewall 132, slotted display panel 122 is thicker in other embodiments.

Slotted display panel 122 includes a plurality of rows of slots 156 and various fastener openings 158 and 160. Slots 156 are employed to receive attachment components 222, which are used for hanging product and/or mirrors. Each row includes an array of slots 156 aligned horizontally end to end. In another embodiment, the slots of the array of slots 156 are aligned vertically end to end. In still other embodiments, slots 156 are arranged in a different pattern, such as in concentric rings, or in a random pattern. Although slots 156 are illustrated as elongated openings, slots 156 are round or have other shapes in alternative embodiments.

Fastener openings 158 are used for fastening horizontal bracket 124 to slotted display panel 122 and are formed through slotted display panel 122 at, for example, locations between two rows of the plurality of rows of slots 156. Fastener openings 160 attach front frame 130 to slotted display panel 122 and are formed through an outer peripheral section 166 of slotted display panel 122. In other embodiments, fastener openings 158 and 160 are formed in other sections of slotted display panel 122, depending on a configuration of horizontal bracket 124 and/or front frame 130. In still other embodiments, one or more slots 156 are designated as fastener openings 158 and/or 160. In one example, in which front frame 130 is eliminated, fastener openings 160 are also eliminated.

Each horizontal bracket 124, 126, and 128 couples slotted display panel 122 to vertical display unit 12 and is configured to be substantially horizontally oriented. In one embodiment, horizontal brackets 124, 126, and 128 are friction fit or otherwise maintained between vertical wall segments 138 and 140 of extended sidewall 132. In another embodiment, extended sidewall 132 is only coupled to horizontal brackets 124, 126, and 128 via slotted display panel 122. Horizontal brackets 124, 126, and 128 are configured to be substantially similar to each other, in an embodiment.

Figure 8:
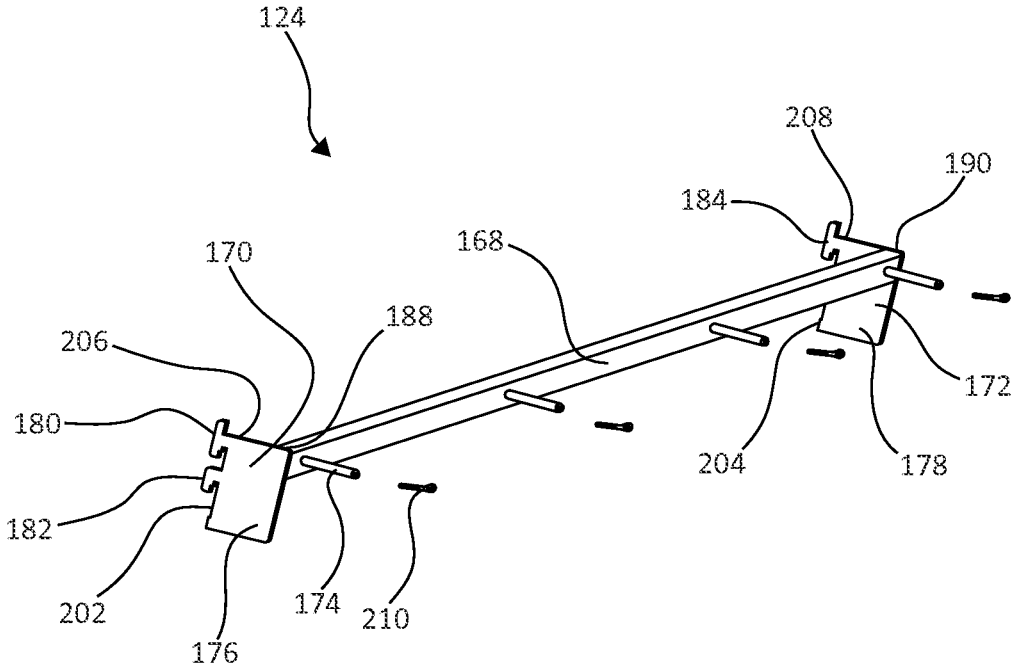
FIG. 8 is a perspective view illustration of a horizontal bracket of the bump out assembly of FIG. 7, according to one embodiment of the present invention.

With reference now to FIG. 8, horizontal bracket 124 (and hence, horizontal brackets 126 and 128) includes an elongated rod 168, hooked brackets 170 and 172, and fasteners or fastener elements 174. Hooked brackets 170 and 172 are disposed on opposing ends of elongated rod 168 and each hooked bracket 170 and 172 includes a bracket plate 176 and 178 and at least one hook 180, 182, and 184. In accordance with an embodiment, elongated rod 168 extends substantially perpendicularly to plates 176 and 178. In another embodiment, plate 176 and/or plate 178 is disposed at a substantially non-perpendicular angle relative to elongated rod 168. Elongated rod 168 extends between top corners 188 and 190 of corresponding plates 176 and 178, in one embodiment. In other embodiments, rod 168 extends between other locations on plates 176 and/or 178. Two hooked brackets 170 and 172 are configured to to be disposed adjacent to an interior surface 192 of two outer peripheral walls 138 and 140 of extended sidewall member 132 or are otherwise configured to fit within sidewall member 132. Hence, horizontal bracket 124 has a width (e.g., widths of plates 176 and 178 and a length of elongated rod 168) that is slight larger than a measurement between vertical wall segments 138 and 140. Additionally, two hooked brackets 170 and 172 are configured to have a depth that is substantially equal to or less than the depth of extended sidewall member 132.

Hooks 180, 182, and 184 (a second hook for plate 178 not shown) are used to couple horizontal bracket 124 to vertical sections 46 and 48 of vertical display unit 12. With additional reference to FIG. 4, each of vertical sections 46 and 48 include a side surface 194 or 196 that each include an array of openings or apertures 198 or 200. The openings of each array of openings 198 and 200 are formed as slits and are arranged end to end. In another embodiment, the openings are substantially circular or have another shape.

Top hooks 180 and 184 and bottom hooks 182 (bottom hook for plate 178 not shown) extend from back edges 202 and 204 of corresponding plates 176 and 178 to engage with corresponding openings of arrays 198 and 200 on vertical sections 46 and 48. Top hooks 180 and 184 extend from a top portion of back edges 202 and 204, respectively, and include one or more protrusions turning upwardly to extend past top edges 206 and 208 of plates 176 and 178, respectively. Bottom hook 182 of plate 176 and bottom hook (not shown) of plate 178 extend from back edges 202 and 204, respectively, below top hooks 180 and 184. Although bottom hooks are illustrated as extending downwardly (e.g., away from top hooks 180 and 184), bottom hooks extend upwardly in other configuration depending on the mechanism on vertical display unit 12 to which each horizontal bracket 124 is coupled. Accordingly, in alternate embodiments, of horizontal bracket 124 includes fewer or more than four total hooks and/or has hooks that extend in a different configuration than as described previously.

Fastener elements 174 attach horizontal bracket 124 to slotted display panel 122. In one embodiment, fastener elements 174 extend from elongated rod 168 in a direction opposite the direction in which hooks 180, 182, and 184 extend from elongated rod 168. Fastener elements 174 are substantially evenly spaced along a length of elongated rod 168. Although four fastener elements 174 are shown, more or fewer are included in other embodiments.

Fastener elements 174 comprise dowels having ends configured to align with fastener openings 158. In an embodiment, fastener elements 174 are inserted into corresponding fastener openings 158. In another embodiment, a fastener 210, such as a flathead screw, nail, or the like, is inserted through fastener openings 160 to attach fastener elements 174 to slotted display panel 122. In one embodiment, a screw, rivet, or other suitable fastener (not shown) having, for example, a head larger than fastener openings 158 is placed trough slotted display panel 122 via fastener opening 158 and into end of corresponding fastener element 174.

Figure 7:
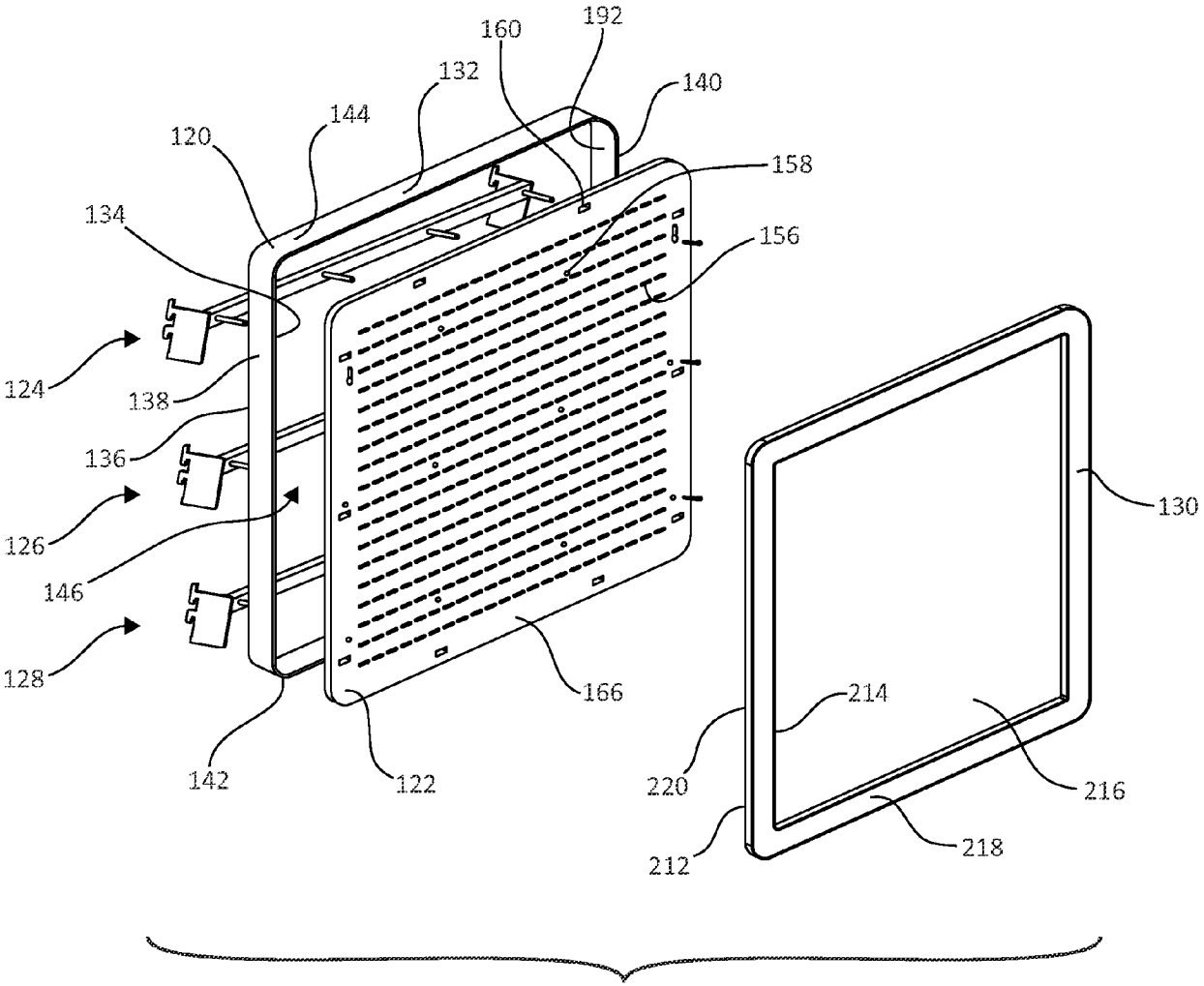
FIG. 7 is an exploded perspective view illustration of a bump out assembly of the enhanced vertical display structure of FIG. 4, according to one embodiment of the present invention.

With reference to FIGS. 4 and 7, front frame 130 improves overall visual appearance of bump out assembly 14 by covering outer peripheral section 166 of slotted display panel 122 (i.e., a front surface of slotted display panel 122 immediately adjacent an outer periphery thereof) to provide a more uniform look to vertical display structure 10 and, in one example, to hide one or more fastener openings 160. Front frame 130 is disposed over outer peripheral section 166 of slotted display panel 122. According to an embodiment, front frame 130 has an exterior frame edge 212 and an interior frame edge 214. Exterior frame edge 212 is larger than interior frame edge 214 to, in one embodiment, thereby define an outer perimeter that is dimensioned and configured to be substantially similar to the outer perimeter of slotted display panel 122. Accordingly, outer frame 120, slotted display panel 122, and front frame 130 have substantially coterminous perimeters. In an embodiment, front frame 130 has a substantially rectangular shape with curved corners. In other embodiments, front frame 130 has a different perimeter shape than slotted display panel 122. Interior frame edge 214 defines an opening 216 therethrough for slots 156 on slotted display panel 122 to remain exposed and accessible.

Front frame 130 has a front or exposed face 218 and a back or non-exposed face 220. Both faces 218 and 220 extend between exterior frame edge 212 and interior frame edge 214. Front face 218 is substantially uniform in color and/or does not include designs imprinted or formed thereon, in an embodiment. Alternatively, front face 218 is used to draw attention to vertical display structure 10 and is multi-colored, has a color that contrasts slotted display panel 122, and/or includes indicia imprinted thereon.

Front frame 130 attaches to fastener openings 160 on slotted display panel 122 via fingers (not shown) that extend from back face 220. In an embodiment, fingers mate and are configured to friction fit with fastener openings 160 and/or are adhered slotted display panel 122 after insertion into fastener openings 160. In other embodiments, front frame 130 attaches to slotted display panel 122 using a different mechanism and/or front frame 130 is eliminated.

Figure 10:
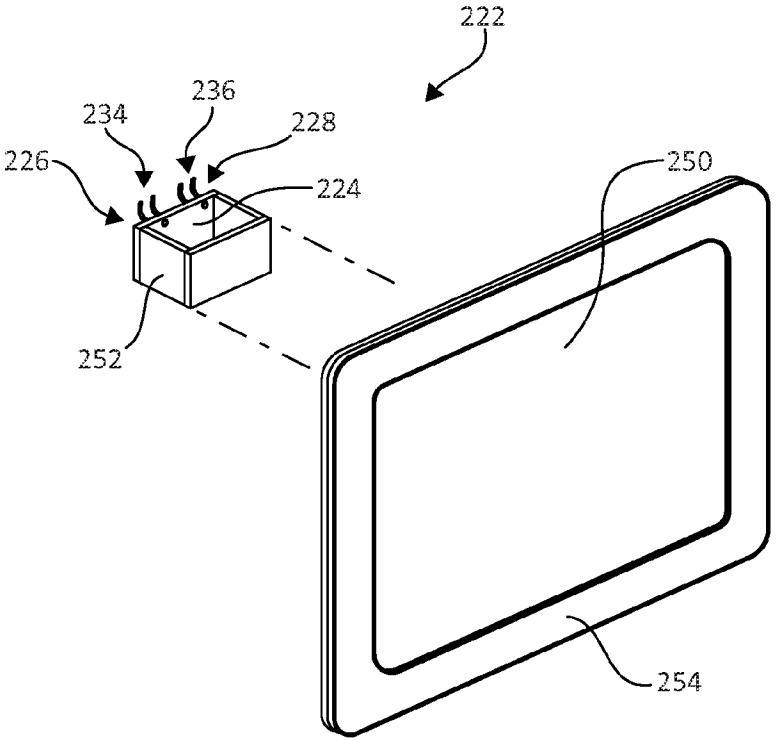
FIG. 10 is a perspective view illustration of a mirror for use on an enhanced vertical display structure, according to one embodiment of the present invention.
Figure 9:
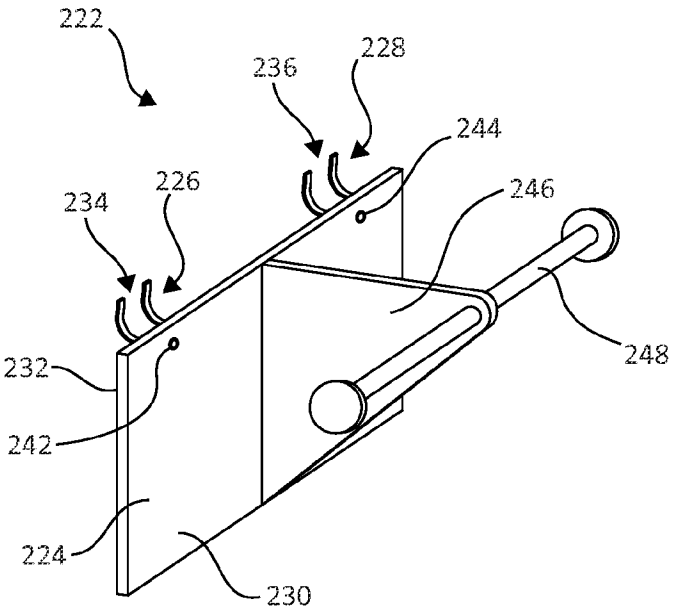
FIG. 9 is a perspective view illustration of an attachment component for use on an enhanced vertical display structure, according to one embodiment of the present invention.
Figure 11:
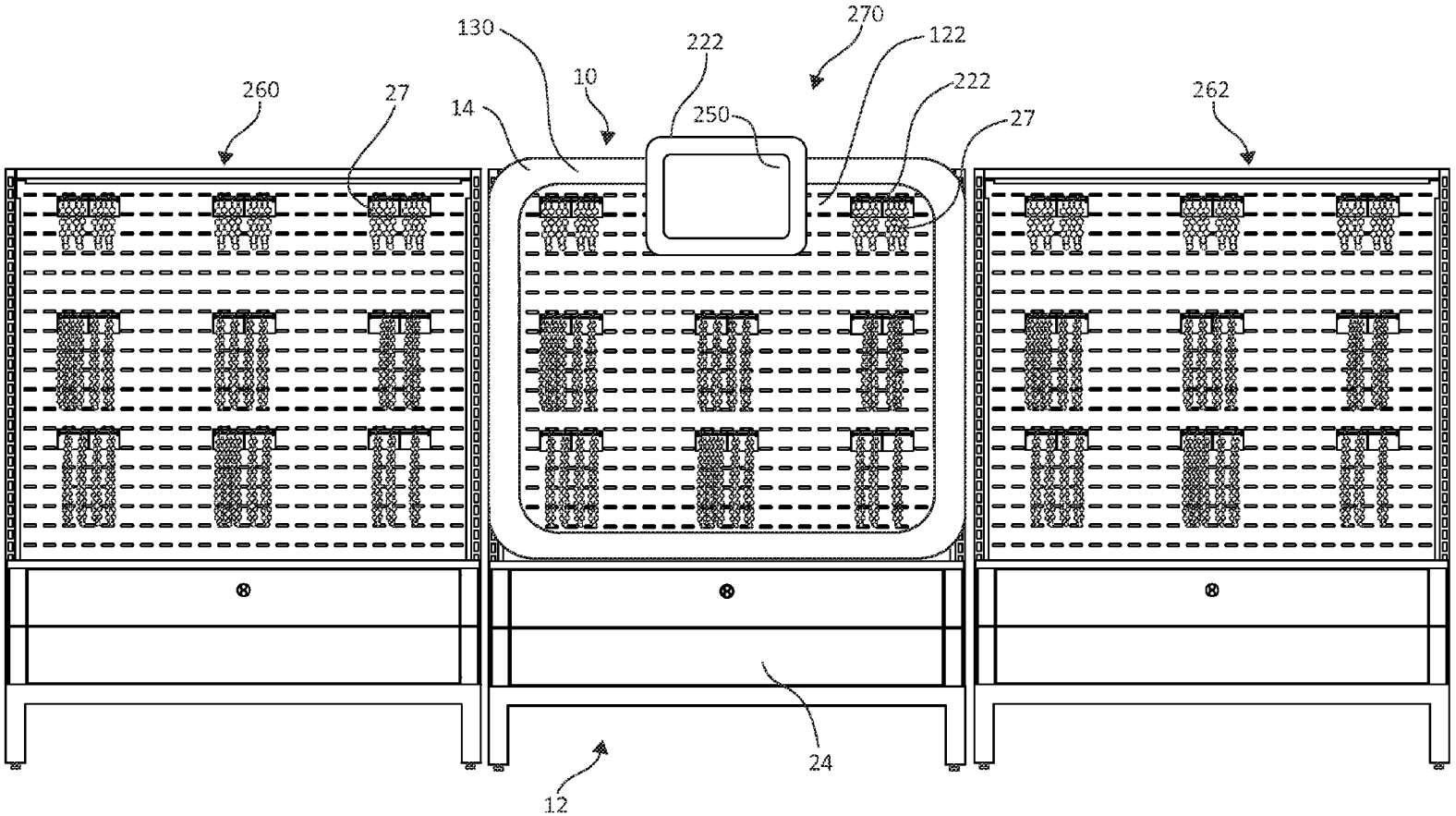
FIG. 11 is a front view illustration of a retail display system including two standard vertical display structures and an enhanced vertical display structure, according to one embodiment of the present invention.

With reference to FIGS. 9-11, as briefly alluded to above, slotted display panel 122 displays various types of items. In this regard, in one example, an attachment component 222 is inserted into one or more slots 156 of slotted display panel 122. Attachment component 222 includes an attachment plate 224 and one or more clips 226 and 228. In an embodiment, attachment plate 224 is a planar element having a front side 230 and a back side 232. Clips 226 and 228 are configured to be inserted into a desired slot in plurality of rows of slots 156. For example, clips 226 and 228 attach to back side 232 of attachment plate 224, and each comprises two pairs of spaced apart prongs 234 and 236. Each prong of pair of prongs 234 extends from a first corner 238 of plate 224, and each prong of pair of prongs 236 extends from a second corner 240 of plate 224. A distance between each prong of pair of prongs 234 and 236 is suitable for both prongs to fit into a single slot of slotted display panel 122. Pairs of prongs 234 and 236 include stems 242 and 244, respectively, secured to attachment plate 224 via openings formed therethrough. In another embodiment, one or both of clips 226 and 228 have a different configuration and/or mechanism securing clips 226 and 228 to attachment plate 224 and/or for interfacing with slots 156. Although two clips 226 and 228 are illustrated, more or fewer clips are included in alternative embodiments.

In an embodiment in which attachment component 222 displays product, attachment component 222 further includes an arm 246 and a bar 248, as illustrated in FIG. 9. Arm 246 extends from attachment plate 224. According to an embodiment, arm 246 is substantially perpendicular relative to attachment plate 224, and bar 248 is coupled to arm 246 through an opening at an end of arm 246. Although arm 246 is shown as being substantially triangular, arm 246 is an elongated rectangle or another configuration in other embodiments. In one embodiment, bar 248 extends substantially perpendicular with respect to arm 246 and is configured to support merchandise on either side of arm 246.

In another embodiment illustrated in FIG. 10, attachment component 222 attaches a mirror 250 to slotted display panel 122 that can be used when a customer wants to see their reflection as they model a product before purchase. Attachment plate 224 is included as part of an extension section 252 that positions mirror 250 a few centimeters away from a surface of slotted display panel 122 to provide additional dimension and interest to vertical display structure 10. In one embodiment, a frame 254 extends around mirror 250 and mimics the shape of the overall look of front frame 130 producing an overall aesthetically pleasing display. It will be appreciated that other hanging assemblies using attachment component 222 or any other fixture assemblies configured to interface with slots 156 to support product in front of slotted display panel 122 are also contemplated and will be apparent to those of skill in the art.

Vertical display structure 10 is used as a standalone display structure, in an embodiment. In another embodiment, vertical display structure 10 is considered an enhanced vertical display structure and is disposed adjacent to one or more vertical display structures or standard vertical display structures 260 and/or 262 (i.e. vertical display structures substantially similar to enhanced vertical display structure 10, but without bump out assembly 14 or 15) to form a retail display system 270 as illustrated in FIG. 11. Enhanced vertical display structure 10 is positioned between two standard vertical display structures 260 and 262, in one embodiment. In another embodiment, one standard vertical display structure is placed between two enhanced vertical display structures 10. In still another embodiment, one standard vertical display structure 260 is disposed adjacent to one enhanced vertical display structure 10. Positioning the enhanced vertical display structures 10 adjacent to one or more standard vertical display structures 260 or 262 provides visual interest to a customer. Additionally, the enhanced vertical display structure 10 serves as a natural visual break line when placed adjacent to one or both of standard vertical display structures 260 and/or 262 resulting in a more appealing and visually stimulating experience for a consumer. A particular configuration of retail display system 270 depends on available floor space and a desired final configuration.

To assemble retail display system 270, one or more bump out assemblies 14 and 15 are attached to a first vertical display unit (e.g., vertical display unit 12) to form enhanced vertical display structure 10. In one embodiment in which product is to be displayed from slotted board 18 and slotted board 22, bump out assembly 14 is attached to slotted board 18, and bump out assembly 15 is attached to slotted board 22. In another embodiment, only one of bump out assemblies 14 and 15 is attached to one of slotted board 18 and 22. The first vertical display 12 has a first pair of vertical supports (e.g., vertical supports 30 and 32) and a horizontal support (e.g., horizontal support 34 or 36). Each bump out assembly 14 and 15 includes a horizontal bracket (e.g., horizontal bracket 124), an outer frame (e.g., outer frame 120), and a slotted display panel (slotted display panel 122), the outer frame surrounds the horizontal bracket, and the horizontal bracket attaches the slotted display panel and the outer frame to the first pair of vertical supports. In one example, each vertical support of the first pair of vertical supports includes an array of openings (e.g., array of openings 198 and 200), and at least one hook on the horizontal bracket inserts into a corresponding opening of the array of openings on a corresponding vertical support.

Before or after bump out assemblies 14 and/or 15 are attached to first vertical display unit 12, one or more bunkers 24 and 26 are coupled to first pair of vertical supports 30 and 32 at a location below bump out assemblies 14 and 15. In another embodiment, the bunkers 24 and/or 26 are omitted from retail display system 270.

After one or both of the bump out assemblies 14 and/or 15 are attached to the first vertical display unit 12, the product 27 is hung on bump out assemblies 14 and/or 15. In one embodiment, attachment component 222 and/or other display fixture accessories is attached to slotted display panel 122, and product 27 is positioned on attachment component 22 and/or the other display fixture accessories. In another embodiment, mirror 250 or other suitable mirror is affixed onto slotted display panel 122.

Figure 12:
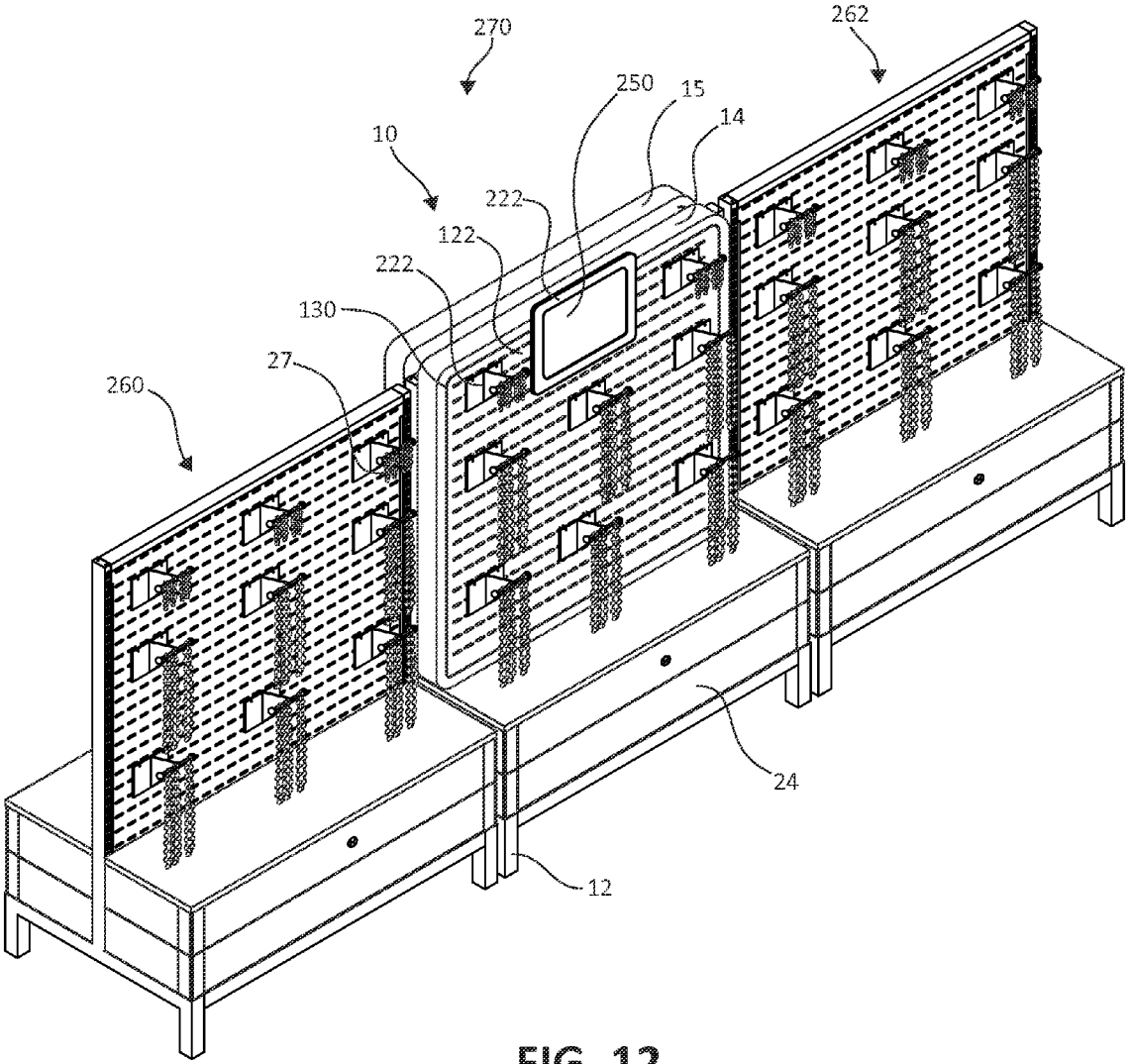
FIG. 12 is a front, perspective view illustration of the retail display system of FIG. 11, according to one embodiment of the present invention.

As shown in FIGS. 11 and 12, first vertical display structure 12 is placed adjacent to a second vertical display structure 260 and/or a third vertical display structure 262, both provided without a bump out assembly. In one embodiment, each of second vertical display structure 260 and/or third vertical display structure 262 is substantially similar to first vertical display structure 12 and includes components substantially similar to those described above for first vertical display structure 12. As will be appreciated, fewer or more first and/or second vertical display structures can be included in other configurations of the retail display system.

A resultant retail display system 270 is now provided that includes various vertical display structures 12, 260 and/or 270 having different configurations to provide interest, and flexibility for changing overall appearance of retail display system 270. An enhanced vertical display structure 10 (e.g., a vertical display structure having one or more bump out assemblies 14 and/or 15) adds visual depth and interest to retail display system 270 when placed adjacent to one or more vertical display structures 260 and/or 262 without a bump out assembly.

Although the invention has been described with respect to particular embodiments, such embodiments are meant for illustrative purposes only and should not be considered to limit the invention. Various alternatives and changes will be apparent to those of ordinary skill in the art. Other modifications within the scope of the invention and its various embodiments will be apparent to those of ordinary skill.

What is claimed is:

1. An assembly for selective coupling to a substantially vertical display structure, the assembly comprising:

a substantially horizontal bracket configured to interface with and hang from the substantially vertical display structure, the substantially horizontal bracket including:

an elongated rod having two opposite ends, two hooked brackets, each of the two hooked brackets extending in a first direction from a different one of the two opposite ends of the elongated rod and being configured to selectively couple with the substantially vertical display structure, and fastener elements extending in a second direction, opposite the first direction, from and spaced along the elongated rod between the two opposite ends;

an extended sidewall member at least partially surrounding the substantially horizontal bracket and extending away from the substantially vertical display structure; and a slotted panel disposed over the extended sidewall member opposite the substantially vertical display structure, wherein the slotted panel is coupled to the substantially horizontal bracket, the slotted panel is maintained horizontally offset from the elongated rod via the fastener elements, the slotted panel defines a first surface horizontally offset and facing away from the substantially vertical display structure, and the slotted panel is configured to support and display product over the first surface offset from the substantially vertical display structure.

2. The assembly of claim 1, wherein:

the extended sidewall member has a first face, a second face, and a plurality of wall segments extending from the first face to the second face to form a cavity within which the substantially horizontal bracket is at least partially disposed.

3. The assembly of claim 2, wherein:

the plurality of wall segments of the extended sidewall member have an interior surface, and the substantially horizontal bracket extends between the interior surfaces of two opposing wall segments of the plurality of wall segments of the extended sidewall member.

4. The assembly of claim 3, wherein:

each hooked bracket of the two hooked brackets includes a bracket plate and a hook, the bracket plate of each hooked bracket is disposed adjacent to the interior surface of the plurality of wall segments of the extended sidewall member and has a first edge and a second edge opposite the first edge, the first edge of the bracket plate of each hooked bracket interfaces with a portion of the slotted panel, and the hook of each hooked bracket extends from the second edge of the bracket plate.

5. The assembly of claim 3, wherein:

the plurality of wall segments has a depth that is greater than a depth of each hooked bracket of the two hooked brackets.

6. The assembly of claim 1, further comprising:

a front frame including an exterior frame edge, an interior frame edge, and an exposed face, wherein:

the exterior frame edge is dimensioned larger than the interior frame edge and is substantially identical to outer dimensions of the slotted panel, and the exposed face extends between the exterior frame edge and the interior frame edge and is positioned to cover a front surface of the slotted panel immediately adjacent an outer periphery of the slotted panel.

7. The assembly of claim 6, wherein the extended sidewall member, the slotted panel, and the front frame have substantially coterminous perimeters.

8. The assembly of claim 1, further comprising:

an attachment component including an attachment plate and a clip extending from the attachment plate, the clip coupling the attachment component to a surface of the slotted panel opposite the substantially horizontal bracket.

9. An assembly for selective coupling to a substantially vertical display structure, the assembly comprising:

a substantially horizontal bracket configured to interface with and hang from the substantially vertical display structure;

an extended sidewall member at least partially surrounding the substantially horizontal bracket and extending away from the substantially vertical display structure; and a slotted panel disposed over the extended sidewall member opposite the substantially vertical display structure, wherein the slotted panel is coupled to the substantially horizontal bracket and defines a first surface horizontally offset and facing away from the substantially vertical display structure, and the slotted panel is configured to support and display product over the first surface offset from the substantially vertical display structure;

wherein:

the substantially horizontal bracket includes a first fastener element extending toward the slotted panel and coupling the substantially horizontal bracket to the slotted panel, the substantially horizontal bracket further includes an elongated rod, a second fastener element, and two hooked brackets, the two hooked brackets extend from opposing ends of the elongated rod in a first direction substantially perpendicular to the elongated rod, and the first and second fastener elements extend from the elongated rod in a second direction, which is substantially opposite the first direction, and are configured to attach the substantially horizontal bracket to the slotted panel.

10. A combination comprising:

a substantially vertical display structure including:

two substantially vertically extending supports each including a side surface having a plurality of apertures extending therethrough, and a board extending between the two substantially vertically extending supports; and an assembly for selective coupling to the substantially vertical display structure, the assembly including:

a substantially horizontal bracket configured to interface with and hang from the substantially vertical display structure;

an extended sidewall member at least partially surrounding the substantially horizontal bracket and extending away from the substantially vertical display structure; and a slotted panel disposed over the extended sidewall member opposite the substantially vertical display structure, wherein the slotted panel is coupled to the substantially horizontal bracket and defines a first surface horizontally offset and facing away from the substantially vertical display structure, and the slotted panel is configured to support and display product over the first surface offset from the substantially vertical display structure wherein:

the substantially horizontal bracket is configured to interact with two or more apertures of the plurality of apertures of each of the two substantially vertically extending supports to hang the assembly from the two substantially vertically extending supports and to position the slotted panel of the assembly apart from and in parallel with the board of the substantially vertical display structure.

11. A retail display system comprising:

a first vertical display structure including a first pair of substantially vertical supports and a first slotted board extending between the first pair of substantially vertical supports; and a bump out unit comprising a substantially horizontal bracket, an outer frame, and a substantially planar panel, the substantially horizontal bracket is coupled to the first vertical display structure, wherein:

the outer frame includes an extended sidewall extending axially from the first vertical display structure and surrounding the substantially horizontal bracket, the substantially planar panel is disposed across the outer frame and includes a plurality of rows of slots configured to receive one or more fixtures for supporting retail product being displayed to potential consumers, and the substantially horizontal bracket couples the outer frame and the substantially planar panel to the first pair of substantially vertical supports.

12. The retail display system of claim 11, wherein:

each substantially vertical support of the first pair of substantially vertical supports has an array of openings, the substantially horizontal bracket includes a substantially horizontal bar and two hooked brackets positioned at opposing ends of the substantially horizontal bar, and a first hooked bracket of the two hooked brackets is attached to a corresponding substantially vertical support of the first pair of substantially vertical supports through at least a first opening of the array of openings of the corresponding substantially vertical support.

13. The retail display system of claim 11, wherein:

the extended sidewall of the outer frame includes a first segment and a second segment, the first segment is spaced apart from the second segment by a first distance, a second distance is defined between a first substantially vertical support and a second substantially vertical support of the first pair of substantially vertical supports, and the first distance is substantially equal to or greater than the second distance.

14. The retail display system of claim 11, wherein:

the extended sidewall has a depth that is substantially equal to or greater than a depth of the substantially horizontal bracket to hide the substantially horizontal bracket from view when the bump out unit is coupled to the first vertical display structure.

15. The retail display system of claim 11, wherein:

the substantially horizontal bracket includes a substantially horizontal bar, two plates, four hooks, and a dowel, the two plates extend from opposing ends of the substantially horizontal bar, a first two hooks of the four hooks extend from a first plate of the two plates, a second two hooks of the four hooks extend from a second plate of the two plates, and the dowel extends from the substantially horizontal bar in a first direction substantially opposite to a second direction in which each plate of the two plates extends from the substantially horizontal bar.

16. The retail display system of claim 11, wherein:

the bump out unit further includes a front frame disposed over the substantially planar panel to cover a front surface of the substantially planar panel adjacent an outer periphery of the substantially planar panel.

17. The retail display system of claim 16, wherein:

the outer frame, the substantially planar panel, and the front frame have substantially coterminous perimeters.

18. The retail display system of claim 11, further comprising:

a second vertical display structure comprising a second pair of substantially vertical supports and a second slotted board supported between the second pair of substantially vertical supports, wherein:

the second vertical display structure is disposed adjacent to the first vertical display structure, and the first and second vertical display structures are aligned such that the substantially planar panel of the bump out unit attached to the first vertical display structure and the second slotted board of the second vertical display structure are substantially vertically offset with respect to each other.

19. A method of forming a retail display system comprising:

attaching a bump out unit to a first vertical display structure, the first vertical display structure including a first pair of substantially vertical supports, the bump out unit including a substantially horizontal bracket, an outer frame, and a slotted display panel, the substantially horizontal bracket being surrounded and substantially hidden from view by the outer frame, and the substantially horizontal bracket configured to attach the slotted display panel and the outer frame to the first pair of substantially vertical supports; and hanging an attachment component for displaying product from the slotted display panel of the bump out unit:

wherein:

the substantially horizontal bracket includes an elongated rod and a fastening element extending therefrom, the outer frame defines a cavity, and the method further comprises:

placing the substantially horizontal bracket in the cavity of the outer frame, and coupling the fastening element of the substantially horizontal bracket to the slotted display panel.

20. The method of claim 19, wherein:

each substantially vertical support of the first pair of substantially vertical supports includes an array of openings, the substantially horizontal bracket includes at least one hook, and the step of attaching comprises inserting the at least one hook of the substantially horizontal bracket into a corresponding opening of the array of openings on a corresponding substantially vertical support of the first pair of substantially vertical supports.

21. The method of claim 19, further comprising fastening a front frame to the slotted display panel.

22. The method of claim 19, further comprising:

placing a second vertical display structure adjacent to the first vertical display structure, the second vertical display structure defining a vertical, substantially planar display surface offset from the slotted display panel in a direction substantially perpendicular to the vertical, substantially planar display surface.

* * * * *